US005628117A

United States Patent [19]

Glesser

[11] Patent Number: 5,628,117

[45] Date of Patent: May 13, 1997

[54] KNIFE WITH REMOTE RELEASE SHACKLE

[76] Inventor: Louis S. Glesser, Box 800, Golden, Colo. 80401-0800

[21] Appl. No.: 517,129

[22] Filed: Aug. 21, 1995

Related U.S. Application Data

[63] Continuation of Ser. No. 246,145, May 19, 1994, abandoned.

[51] Int. Cl.[6] ..... B26B 29/02

[52] U.S. Cl. ..... 30/298.4; 30/155; 224/679

[58] Field of Search ..... 30/155, 298.4, 30/296.1; 7/118–120; 224/226, 232; 24/374

[56] References Cited

U.S. PATENT DOCUMENTS 362,718 5/1887 Brueckner ..... 24/374

4,342,410 8/1982 Sloan ..... 224/226 X 4,776,094 10/1988 Glesser ..... 30/298.4 X

*Primary Examiner*—Douglas D. Watts

[57] ABSTRACT

The invention is a folding knife with a shackle. The shackle can be opened from a remote location by a shackle retractor mechanism made up of a retractor, a spring and a closure element. Each can be sited at a variety of locations on a knife. The retraction mechanism can be actuated by a knob, nut, handle, gear, cam or lift unit and can be attached to the shackle closure by a rod, "cord," chain, wire or similar means. The cord can be woven, plaited or twisted and of metal and/or non-metal composition.

18 Claims, 4 Drawing Sheets

KNIFE WITH REMOTE RELEASE SHACKLE

This application is a continuation of Ser. No. 08/246,145 filed May 19, 1994, now abandoned.

BACKGROUND OF INVENTION

U.S. Pat. No. 4,776,094 issued to Louis Glesser teaches a folding utility knife having a snap shackle positioned parallel to and on the same end of the knife as the blade. A spring biases the closure in the closed position and the closure itself must be pushed to open the shackle. Previously, locks and/or snap shackles had been attached to the other end of the knife handle.

The Glesser design enabled parachutists and others to quickly remove the knife from a harness and open the blade with the thumb of one hand when in trouble. The design has proved to be a lifesaver. However, the placement of the snap shackle parallel to the blade is perceived by some to reduce the utility of the knife for non-emergency uses.

The folding knife of the present invention has a shackle which is remotely released. As a result, the benefits of the Glesser design for emergency use, other special purpose and everyday usage can be combined into one design.

SUMMARY OF THE INVENTION

A releasable shackle can be placed on either end, or even the side, of a folding knife where the shackle closure release is remotely controlled. Such knives have a shackle made up of a "hook" and a retractable closure. The closure includes a shackle, a spring mechanism for biasing the closure in the closed position, and a retractor for retracting the closure.

DETAILED DESCRIPTION OF THE FIGURES

Figure 1:
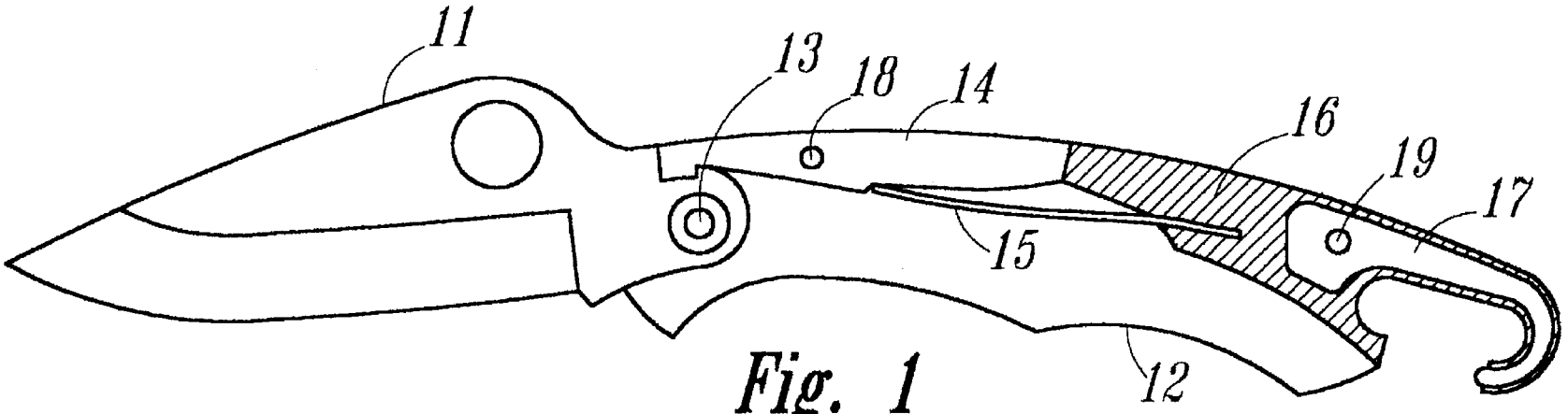
FIGS. 1–4 depict several aspects of a preferred embodiment.

FIG. 1 depicts a knife having a blade 11 and a molded handle 12 which is attached to the blade by a rivet 13. Blade 11 is maintained in the "open" position shown by release 14. Blade 11 is allowed to move toward a "closed" position within the handle 12 by downward pressure on release 14 and, in turn, against a spring 15 which is embodied, at its rear, shown in section at 16 in handle 12 along with a metal hook 17. Release 14 pivots on rivet 18 while handle 12 and metal hook 17 are perforated by hole 19.

Figure 2:
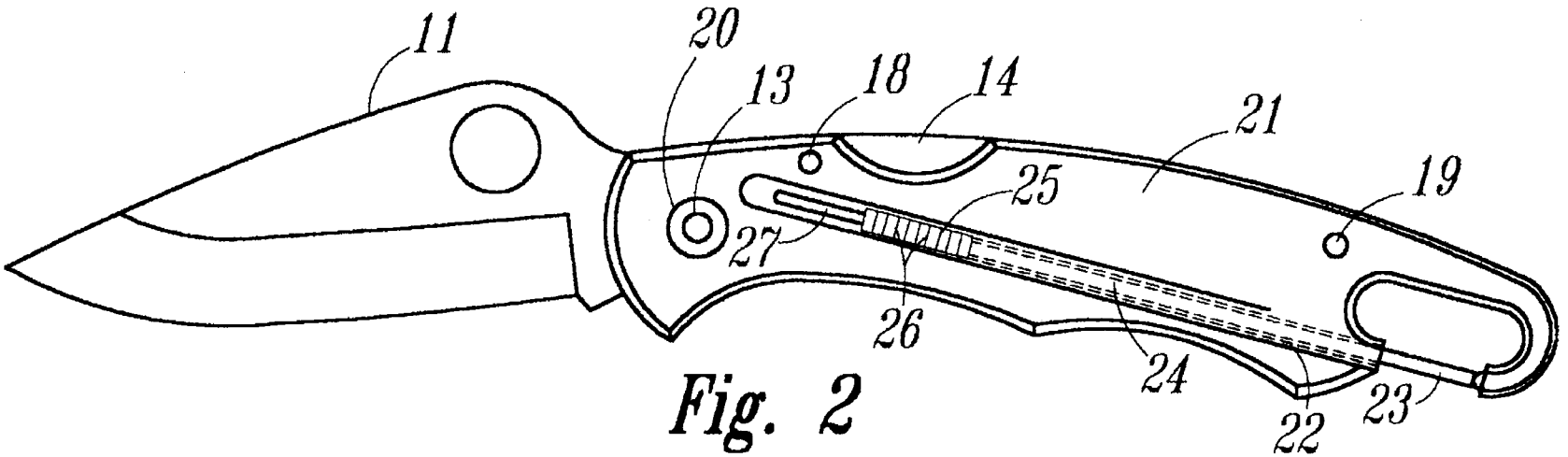

In FIG. 2, a cover 21 covers and is mated with handle 12 by the head 20 of rivet 13. Cover 21 has, on its underside, a groove 22 into which a shackle closure mechanism is fitted. The closure mechanism includes a shackle closure 23, a rod 24 and a knob 25. Knob 25 has indentations 26 on its upper surface and is attached to rod 24 through a slot 27.

Figure 3:
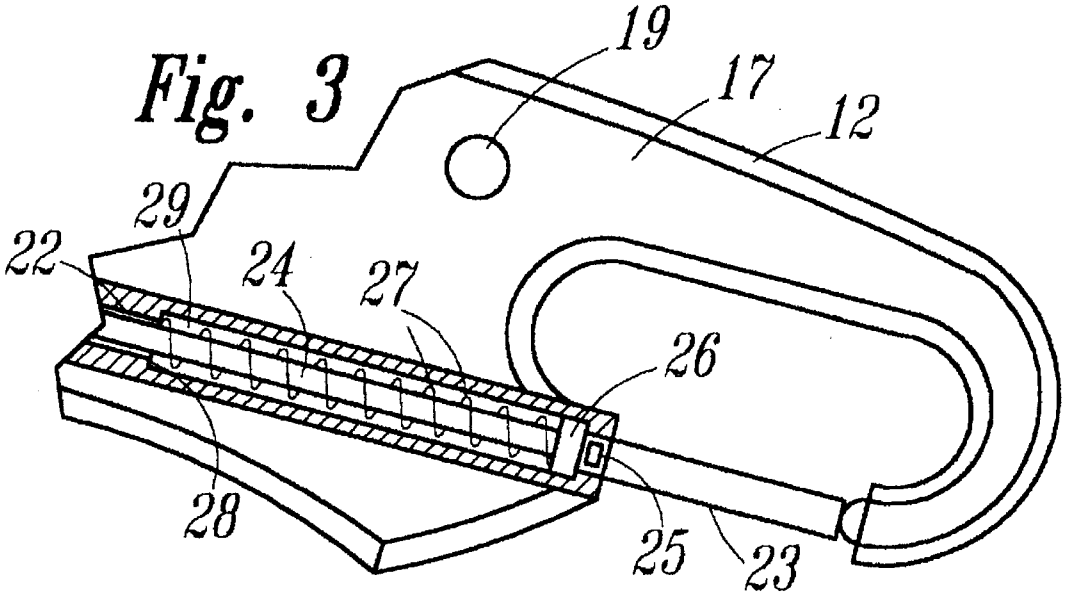

FIG. 3 shows the attachment of closure 23 to rod 24 by crimping at point 25. The anterior end of closure 23 is swaged to form a seat 26 for spring 30. Spring 30 biases closure 23 in the closed position and is opened by use of a finger to move knob 26 forward toward blade 11. Spring 30 is seated, at its anterior end, against the shoulder 28 in an enlarged part 29 of groove 22.

Figure 4:
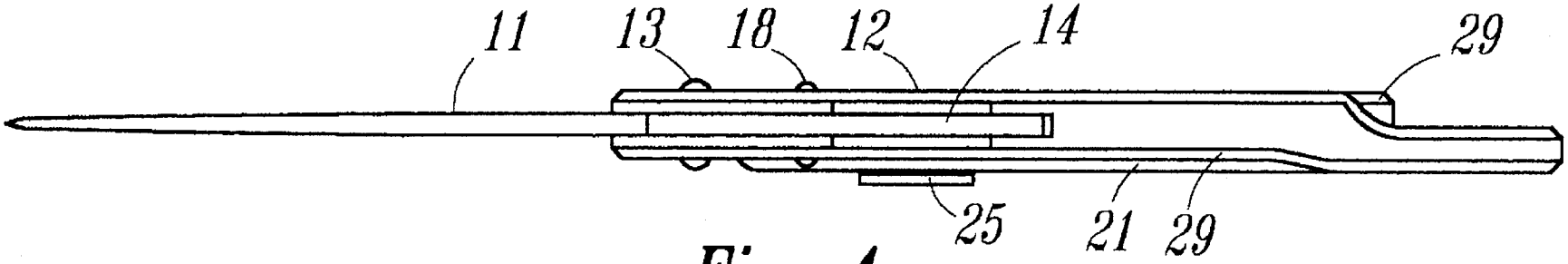

The top view of FIG. 4 shows the exterior elements of the knife and highlights the beveled edges 29 of the design.

Figure 5:
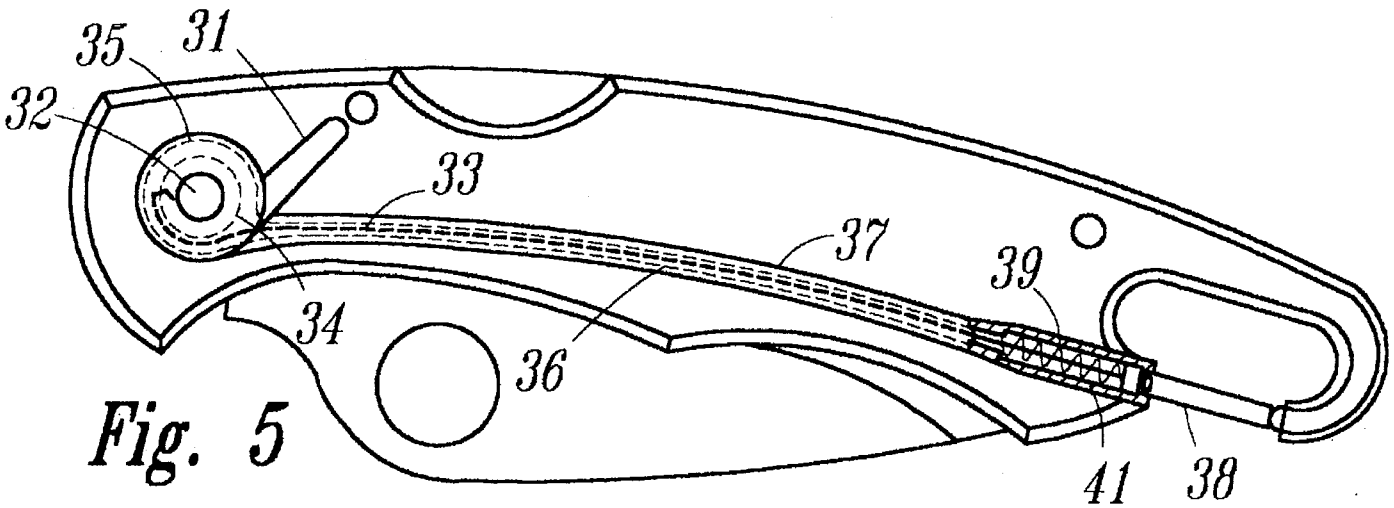
FIG. 5 is a side view of an embodiment using a lever as a retractor for the shackle closure.

FIG. 5 depicts a handle-operated remote shackle closure. In this embodiment, a handle 31 is rotated around a screw or rivet 32 to wind a flexible wire "cord" or chain 33 around drum 34 seated within seat 35. Wire cord or chain 33 is fitted within a channel 36 within shallow ridge 37.

Figure 6:
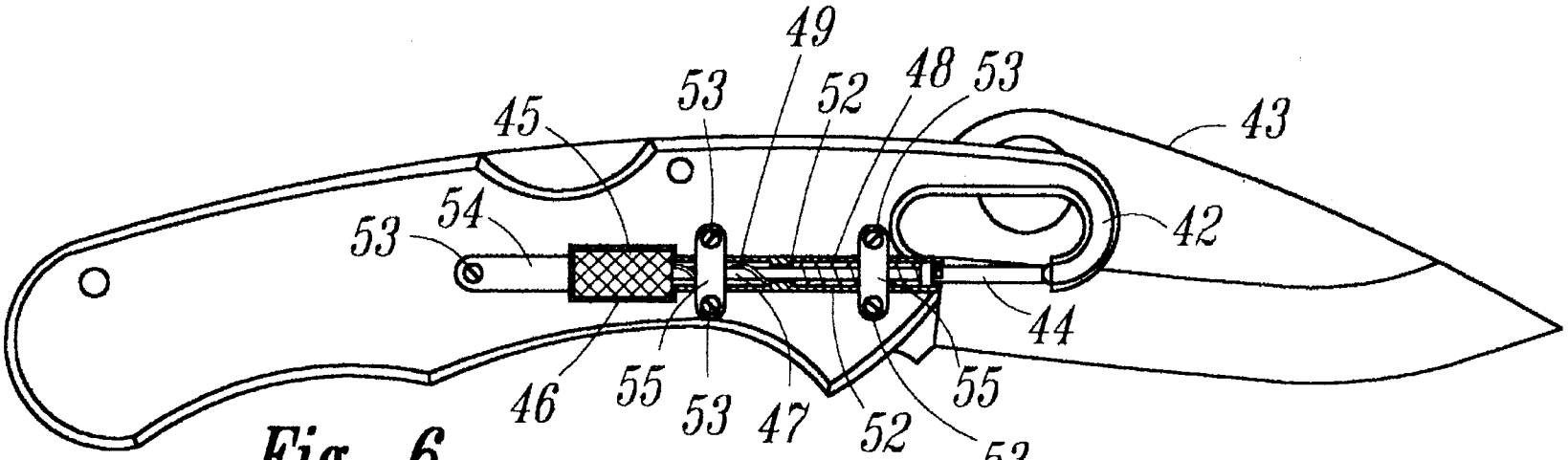
FIG. 6 is a side view of a knife utilizing a knurled nut as a retractor.

FIG. 6 depicts another embodiment where the hook 42 is adjacent to the blade 43 and the shackle closure 44 is retracted by a knurled nut 45 partially fitted into a recess 46. The nut 45 is internally threaded and, when rotated, forces externally threaded rod 47 to move laterally much as a crescent or "monkey" wrench jaw is moved. Spring 48 biases shackle closure toward the closed position when the nut 45 is released because of the high angle of threads 49. Nut 45, rod 47 and spring 48 are held within groove 52 by screw 53 anchoring end plate 54 and bands 55.

Figure 7:
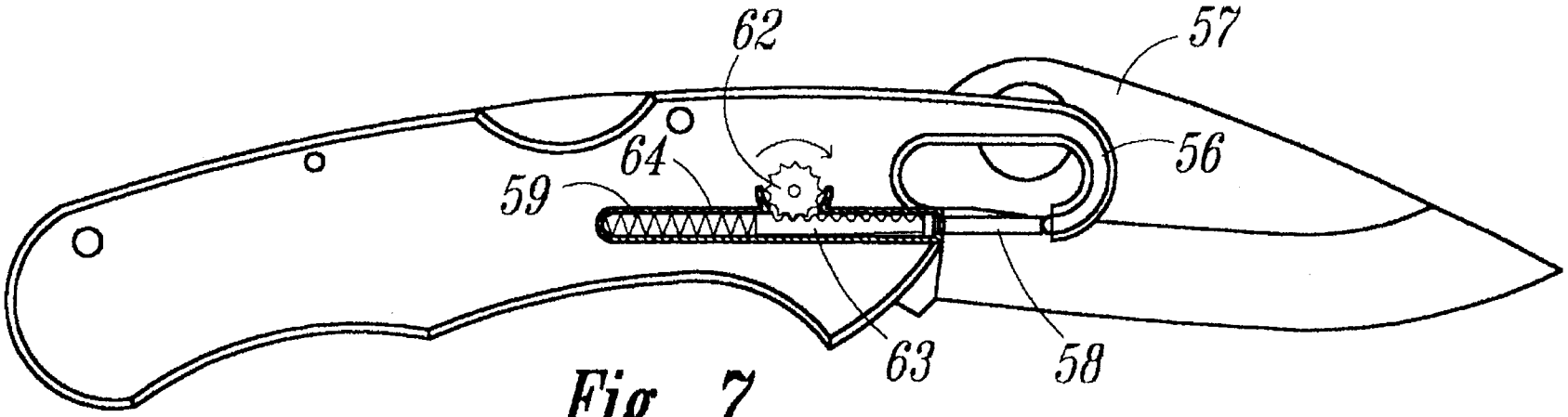
FIG. 7 is a side view of a knife utilizing a rotatable nut and rack as part of a retractor mechanism.

FIG. 7 depicts a cutaway through a part of still another embodiment where a hook 56 is positioned parallel to blade 57. Shackle closure 58 is biased by spring 59 toward the tip of hook 56 and is moved laterally by the turning of geared wheel 62. The wheel 62 moves rack 63 laterally as it is turned. The spring 59, a portion of wheel 62 and rack 63 rest in a channel 64 (shown with the cover cut away).

Figure 8:
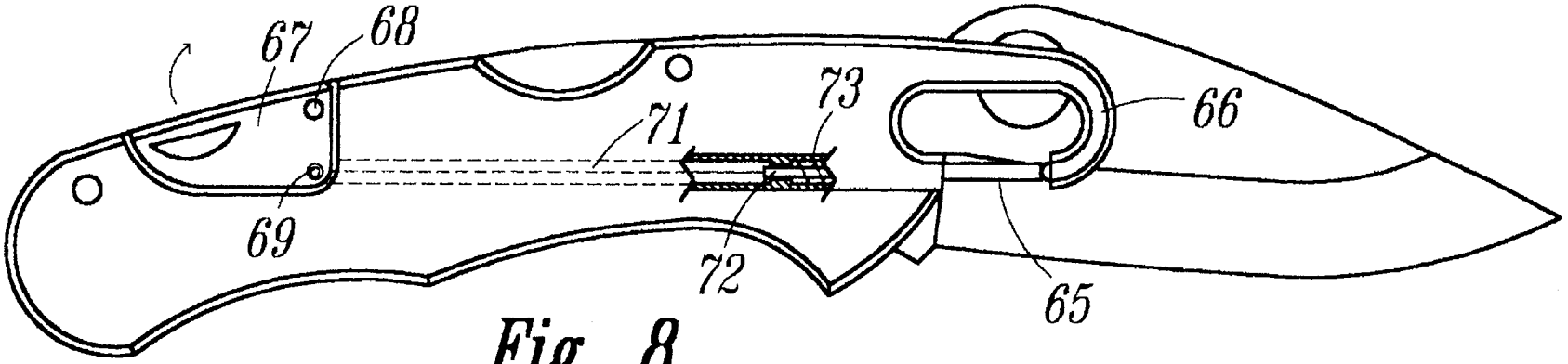
FIG. 8 is a side view of a knife utilizing a lift mechanism for retraction.

FIG. 8 shows still another embodiment where the shackle closure 65 is moved away from the hook 66 when retractor 67 is lifted upwardly by the fingers of the user (not shown). Retractor 67 pivots around rivet 68 and is attached, at anchor 69, to chain 71 which is in turn attached to rod 72 (shown in cutaway). Rod 72 and shackle closure 65 are biased toward hook 66 by spring 73.

GENERAL DESCRIPTION OF THE INVENTION

The inventive concept of a remotely operated retractor mechanism for a folding knife having a shackle allows for many mechanisms for accomplishing the desired result. Several additional retractor systems based on the principle will be obvious to those skilled in the art because the concept provides for great design flexibility when each element is considered. Thus, the drawing shows that retraction can be accomplished by several means, all at a point spaced apart from, i.e., remote from the closure. Others are available, e.g., via camming or depressing mechanisms. Additionally, while a spiral spring is taught in each of the embodiments of the Figures, other types of springs can be utilized, e.g., hairpin springs. The spring(s) can also be used to position the closure in either of the open, closed or both open and closed position(s), e.g., where it is desired to hang the knife on a support between frequent uses.

While the shackle is shown in hook form, it can be in other forms, e.g., with two pincer jaws.

The shackle closure release mechanism is shown positioned in and on the handle, in a cover and in a slot in the handle in instances where there is not intended to be a cover and marketing dictates an "open" design. These various design approaches provide the knife designer with great opportunities and resulting greater knife utility.

I claim:

1. A knife comprising an elongated handle having at least one elongated cavity for containing a portion of at least one folded blade;

at least one blade pivotably attached to the handle to remain in either of an open position or a folded position at least partially within the handle;

a shackle, with a retractable closure means, which includes a spring means for biasing the retractable closure means in a normally closed position;

a shackle closure retraction means spaced apart from the shackle for moving the retractable closure means into an open position.

2. In a folding knife having a shackle including a closure means which is normally in a closed condition but which can be moved to an open position and a blade pivotally attached to the handle at one of its ends, the improvement comprising a slideable retractable shackle closure means, biased in the closed position, on the end of the handle opposite to the blade and a shackle closure retraction means positioned proximate to the blade end of the handle connected to the shackle closure means for moving the shackle closure means from a closed position to an open position.

3. The knife of claim 1 further including positioning means for affixing the spring means and retractor means in at least one of in and on the handle.

4. The knife of claim 2 wherein the positioning means is a cover for the spring means and at least a portion of the closure means.

5. The knife of claim 1 wherein the retractor means is a nut.

6. The knife of claim 1 wherein the retractor means is a handle with a drum means for displacement of the closure means.

7. The knife of claim 1 wherein the retractor means is a knob.

8. The knife of claim 1 wherein the spring means biases the closure means in the closed position.

9. The knife of claim 1 wherein at least a portion of the closure retraction means is a chain.

10. The knife of claim 1 wherein at least a portion of the closure means is a wire.

11. The folding knife of claim 2 wherein the retractable closure means includes a spring.

12. The folding knife of claim 2 wherein the retractable closure means includes a chain.

13. The folding knife of claim 2 wherein the retractable closure means includes a cord.

14. The folding knife of claim 2 wherein the retractable closure means includes a rod.

15. The folding knife of claim 2 wherein the retractable closure means includes a geared wheel.

16. The folding knife of claim 2 wherein the retractable closure means includes a handle.

17. The folding knife of claim 2 wherein the retractable closure means includes a drum means.

18. The folding knife of claim 2 wherein the retractable closure means includes a knob lifting means.

* * * * *